United States Patent [19]

Heyne et al.

[11] Patent Number: 4,710,739

[45] Date of Patent: Dec. 1, 1987

[54] CIRCUIT BREAKER HAVING SHOCK-PROOF TRIP-ACTUATING ASSEMBLY

[75] Inventors: Carl J. Heyne, Hampton Twp., Allegheny County; Nicholas A. Tomasic, Plum Borough, both of Pa.

[73] Assignee: Westinghouse Electric Corp., Pittsburgh, Pa.

[21] Appl. No.: 885,633

[22] Filed: Jul. 15, 1986

[51] Int. Cl.[4] ..... H01H 9/00

[52] U.S. Cl. ..... 335/174; 335/63; 335/167; 335/170

[58] Field of Search ..... 335/63, 174, 167, 168, 335/169, 170, 174, 175

[56] References Cited

U.S. PATENT DOCUMENTS 3,414,852 12/1968 Martin ..... 335/170

3,808,567 4/1974 Maier ..... 335/167

*Primary Examiner*—E. A. Goldberg

*Assistant Examiner*—Lincoln Donovan

*Attorney, Agent, or Firm*—L. P. Johns

[57] ABSTRACT

The trip mechanism of a molded case type circuit breaker is actuated by a plunger that is integral with and axially extends from the end of a reciprocally-movable core member of a solenoid mounted within the breaker housing. The free end of the plunger strikes the trip bar of the breaker when the solenoid is energized in response to a current overload condition in the circuit being protected. The solenoid core member and plunger are mechanically locked in NO-TRIP position by spring-biased keeper means that is automatically released from its "lock" position by the magnetic field generated by the solenoid coil when it is energized. A spring automatically resets the trip-actuating assembly when the current-overload condition has been corrected and the solenoid coil is deenergized. The trip-actuating assembly is not only compact, reliable and inexpensive but is inherently adapted to withstand severe mechanical shocks and impacts, such as those encountered aboard naval vessels, and is thus especially suited for use in circuit breakers that will be employed to protect electrical circuits and equipment subjected to such rough service conditions.

7 Claims, 15 Drawing Figures

CIRCUIT BREAKER HAVING SHOCK-PROOF TRIP-ACTUATING ASSEMBLY

BACKGROUND OF THE INVENTION

1. Field of the Invention

This invention generally relates to circuit interrupter apparatus and, more particularly, to an improved trip-actuating assembly for a molded case type circuit breaker that is designed for shipboard use and is thus subjected to mechanical shocks and vibrations of unusual severity.

2. Description of the Prior Art

Circuit breakers and related electrical generation and distribution equipment for shipboard use require special design features insofar as they must operate under adverse environmental conditions characterized by high humidity, salt water spray, high ambient temperatures, high vibration levels and high mechanical shock loads. As will be appreciated by those skilled in the art, reliable operation of the electrical equipment under such adverse operating conditions is very difficult to achieve, particularly with regard to the requirement that the equipment be able to withstand mechanical shocks and impacts. This is of special importance in the case of naval vessels that frequently experience shocks and vibrations of very high magnitude during combat when operation of the electrical system is most crucial and difficult. Various modifications to the electrical equipment intended for shipboard use have accordingly been developed over the years to render it shock-proof. However, these modifications not only increased the cost of the apparatus but complicated its manufacture on a mass production basis. Such drawbacks are of even greater significance in the design and marketing of molded case circuit breakers which are traditionally low cost, compact devices that are inherently sensitive to mechanical shocks and impacts. The need to instantly trip on high currents makes the trigger mechanism of such breakers sensitive to shock loads while the compact designs and low cost make it very difficult to provide a cost-effective reliable shock-resistant tripping mechanism in the available space within the breaker case.

A shock-resistant trip device currently used in commercial circuit breakers of the molded case type utilizes a rotatable trigger component that has a protruding latch which engages a slidable release member and holds the spring-loaded tripping mechanism of the circuit breaker in contact-closed position. The rotatable trigger component is spring biased to keep it in latched relationship with the release member and the trigger component is actuated by a magnetic trip device consisting of an electromagnet that is energized when a current overload condition is created by a fault or some other malfunction in the electric circuit being protected. The electromagnet attracts a pivoted clapper that has an end portion which engages a protruding tab-like portion of the rotatable trigger component and moves the trigger component a sufficient distance against the action of the biasing spring that the trigger latch is disengaged from the release member—thus permitting the cocked driving springs and toggle assembly of the breaker mechanism to slide the release member in a direction which allows the trip mechanism to open the breaker contacts and quickly interrupt the circuit. In accordance with standard design practice, the circuit breaker is restored to contact-closed position by a manual or motor operated closing sequence which extends or compresses suitable springs in the trip mechanism and stores the energy required for the next trip operation. The springs are prevented from tripping the circuit breaker by the slidable release member which, in turn, is controlled by the rotatable trigger component and its latch.

While such shock-resistant tripping mechanisms are in widespread use in commercial type molded case circuit breakers and function satisfactorily, they are not suitable for use in circuit breakers installed on naval vessels since the severe shock loads encountered aboard such vessels are sufficient to actuate the triggering mechanism and cause the breaker to be tripped from mechanical as well as electrical loads. Since the shock loads are most intense during combat the accidental tripping of circuit breakers under such conditions is intolerable since it deprives the ship of electrical power when it is most needed.

In order to make the aforementioned prior art tripping mechanism less sensitive to mechanical shocks and impacts inertia wheels were added to the mechanism to prevent the trigger component from reacting to high frequency mechanical loads. The inertia wheels were coupled to the rotatable trigger component in such a way that they prevented the rapid acceleration of the trigger component and thus helped to isolate the trigger component from impulse-type shock loads. While this arrangement improved the shock tolerance of the tripping mechanism, it was not "fail safe" and it is relatively ineffective for high amplitude, low frequency shock loadings of the kind that would be encountered aboard naval vessels.

It would, accordingly, be very advantageous from both a functional and marketing standpoint if a circuit breaker could be provided with a shock-proof triggering device that was compact, reliable, low in cost and geometrically flexible enough to be easily adapted to the available space in the molded case breakers now being manufactured and marketed and thus produce circuit breakers of this type that have the operational stability and ruggedness required for shipboard use and similar rough service applications.

SUMMARY OF THE INVENTION

The present invention provides the foregoing manufacturing, operational and marketing advantages by utilizing a trip-actuating mechanism that decouples the mechanical latch release mechanism from external shock loads while providing very rapid response to an electrical overload signal so that the circuit breaker will be tripped in a reliable and positive manner only when it is necessary to interrupt the electrical circuit due to a fault or other potentially dangerous malfunction. Such decoupling "desensitizes" the mechanical trip mechanism from the external shock loadings to which the circuit breaker is subjected during use and, in accordance with the present invention, is accomplished by means of a trip-actuating assembly having a unique shock-proof lock mechanism that insures that the circuit breaker is maintained in spring-loaded contact-closed NO-TRIP condition until a current overload signal is received that releases the lock mechanism and trip-actuating assembly and rapidly initiates the trip sequence. The lock mechanism utilizes either a rotating or reciprocally-movable magnetic keeper which is held in "lock" position by a spring and is moved to "unlock"

position for breaker tripping by a magnetic field that is generated by an electromagnet.

In the disclosed embodiments the electromagnet comprises a solenoid which also serves as the motive source which propels a plunger into engagement with the pivoted trip bar of the circuit breaker, thus releasing the breaker latch mechanism and triggering the spring-loaded trip mechanism with resultant rapid opening of the breaker contacts.

In accordance with one form of the invention the plunger comprises a longitudinally extending appendage of the movable core of the solenoid and locking of the solenoid in NO-TRIP position is effected by a spring-biased keeper of magnetic material that is movably mounted within an opening of a metal yoke-chassis that extends around and supports the solenoid. The yoke-chassis constitutes a magnetic circuit that concentrates magnetic flux in the opening, when the solenoid is energized, which automatically retracts the keeper from locking engagement with the core member of the energized solenoid and thus permits the solenoid core member and its plunger appendage to be rapidly propelled toward and strike the trip bar of the circuit breaker.

In an alternative embodiment, the locking means comprises a non-magnetic stop which engages a protruding lobe element of the solenoid core member when the latter is in its dormant NO-TRIP mode. When a current overload condition in the circuit is sensed and the solenoid is energized by a suitable solid-state control circuit provided within the breaker housing, the solenoid core member automatically rotates through a predetermined angle until it is aligned with a magnetic pole piece provided on the yoke structure. Such rotation permits the lobed portion of the core member to slip over and pass the stop member with resultant release of the core member and plunger from their locked position. A suitable spring means automatically returns the lobed portion of the solenoid core member to its locked NO-TRIP position on the stop when the solenoid is deenergized after the circuit breaker has been tripped and the breaker contacts opened.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the improved trip-actuating assembly of the present invention can be employed in various kinds of circuit interrupting apparatus that are used in environments which subject the apparatus to vibration and mechanical shocks, it is particularly adapted for use in conjunction with low voltage circuit breakers of the molded case type that are employed aboard ships and naval vessels that require circuit breakers which will not be inadvertently tripped in rough seas or under combat conditions and will operate reliably in such adverse environments.

Figure 1:
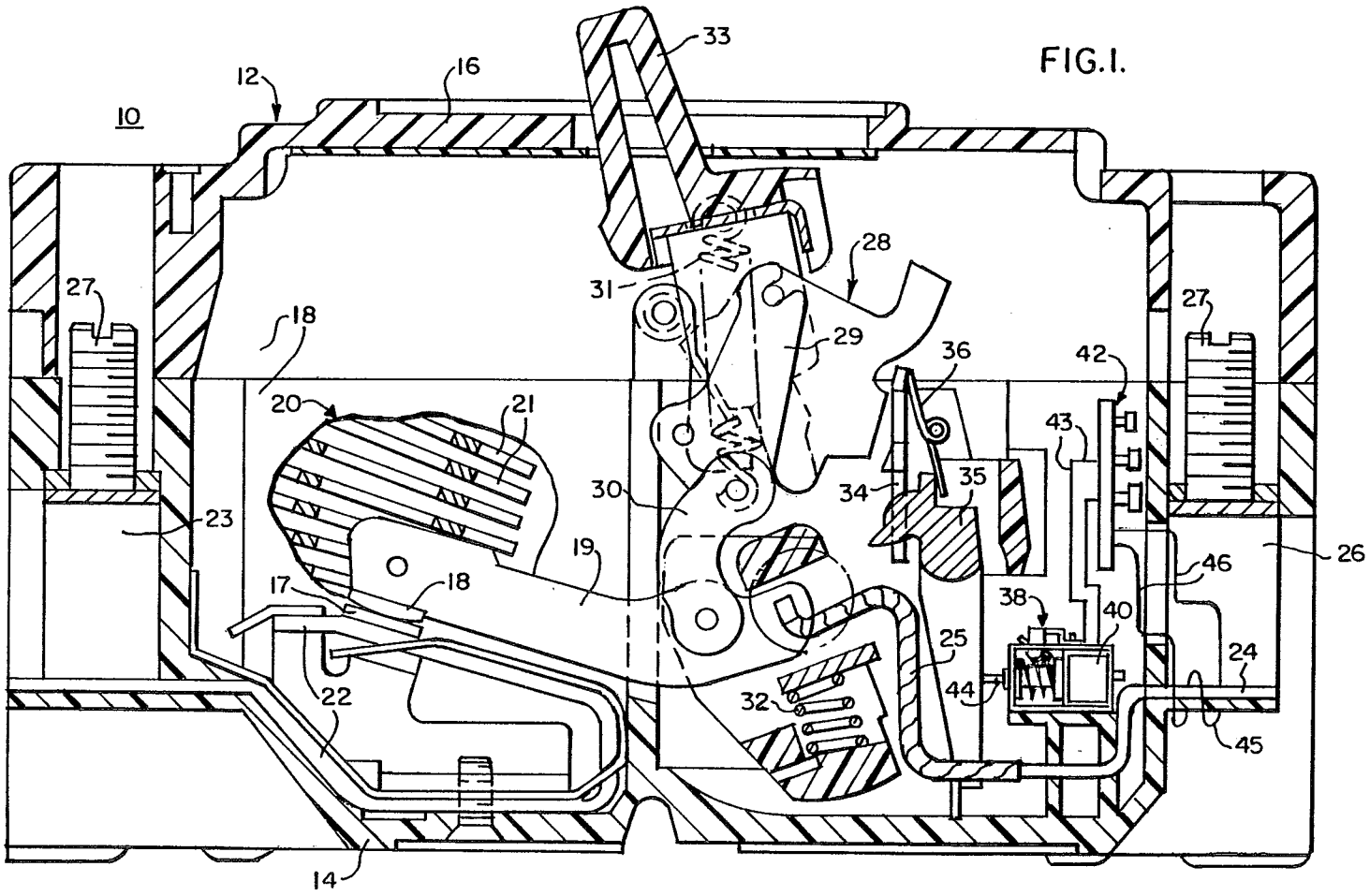
FIG. 1 is a sectional view through the center pole portion of a three-pole molded case circuit breaker of the low-voltage type which incorporates the improved trip-actuating assembly of the present invention.

In FIG. 1 there is shown a molded case three-pole circuit breaker 10 which comprises a housing 12 that is fabricated from a suitable insulative material and includes a base component 14 and a removable cover component 16. Insulating barrier means 18 within the housing 12 defines, in conjunction with the base 14 and cover 16, three adjacent compartments that contain the three pole units. One of the pole units is shown in FIG. 1 and consists of the usual stationary contact 17 and a movable contact 18 that are located (when in their closed position as shown) within the confines of an arc chute assembly 20 which defines an arc extinguishing chamber. The arc chute assembly 20 comprises the usual series of vertically stacked arc chute plates 21 that are designed to divide the arc into small segments and rapidly extinguish it when the circuit breaker 10 is tripped and the contacts 17, 18 are suddenly opened. The stationary contact 17 is mounted on a rigid conductor 22 that extends through the end wall of the housing 12 and is connected to a suitable terminal block 23. The movable contact 18 is mounted on a contact arm 19 that is pivotally supported within the base component 14 and connected to a second rigid conductor 24 by a flexible conductor 25. The end of rigid conductor 24 extends through the other end wall of the base component 14 and is connected to a second terminal block 26. Each of the terminal blocks 23, 26 include a lock screw 27 that is adapted to engage and tightly clamp cable conductors (not shown) that are inserted into the terminal blocks.

An operating mechanism 28 (which is common to and operates each of the three pole units) is provided for simultaneously actuating the three movable contacts in each of the three circuit breaker compartments between their open and closed positions. The operating mechanism 28 includes the usual toggle links 29, 30 that are pivotally connected together by a knee pivot. Toggle link 30 is pivotally attached to the movable contact arm 19 and the interaction of the various parts of the operating mechanism 28 is such that the movable contact arm 19 and its contact 18 are rapidly swung upwardly away from the stationary contact 17 by the action of a pair of springs 31, 32 when the circuit breaker 10 is tripped. The operating lever of the toggle linkage is fastened to an insulating handle 33 which extends through a suitable opening in the cover 16 and permits the operating mechanism 28 to be restored to spring-loaded contact-closed condition after the breaker 10 has been tripped. The operating mechanism 28 is held in its "contact-closed" condition against the action of the power springs 31, 32 by a trip latch 34 that is captured by a pivoted trip bar 35 which is held in such relationship with the latch 34 by a suitable spring 36.

In accordance with the present invention, the triggering of the trip mechanism is achieved by a trip-actuating assembly 38 that comprises a solenoid 40 which is energized in response to a current overload or fault condition that is sensed by suitable means and transmitted to a solid-state control and power circuit module 42 connected to the solenoid 40 by a pair of conductors 43. As illustrated in FIG. 1, the trip-actuating assembly 38 is very compact and is mounted within the base portion 14 of the circuit breaker 10 in close proximity to the trip bar 35 so that a protruding actuator member, such as a rod-like plunger 44, is positioned to engage and push the lower end of the trip bar 35 a sufficient distance to release the trip latch 34 and initiate the breaker-tripping sequence when the solenoid 40 is energized. In this particular embodiment, the current-overload sensing means comprises a current transformer 45 that is coupled to the main conductor 24 and is connected by suitable wires 46 to the solid state control circuit module 42. The structural details of the trip-actuating assembly 38 and the manner in which the solenoid-powered plunger 44 is mechanically locked in NO-TRIP position despite the intensity of the physical shocks and vibration experienced by the circuit breaker 10 during use is illustrated in FIGS. 2–4 and will now be described.

Figure 2:
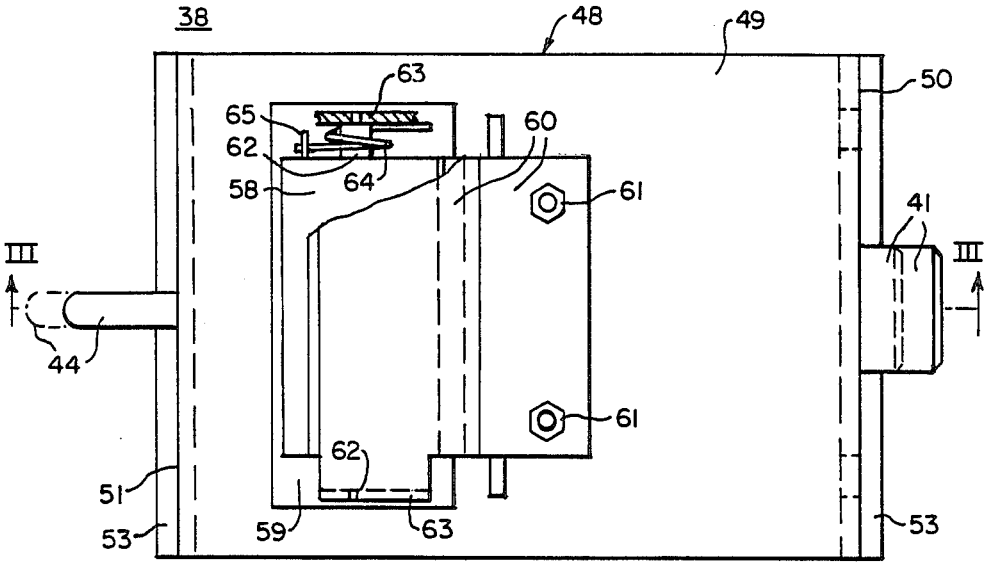
FIG. 2 is an enlarged top plan view of the trip-actuating assembly employed in the circuit breaker shown in FIG. 1.
Figure 3:
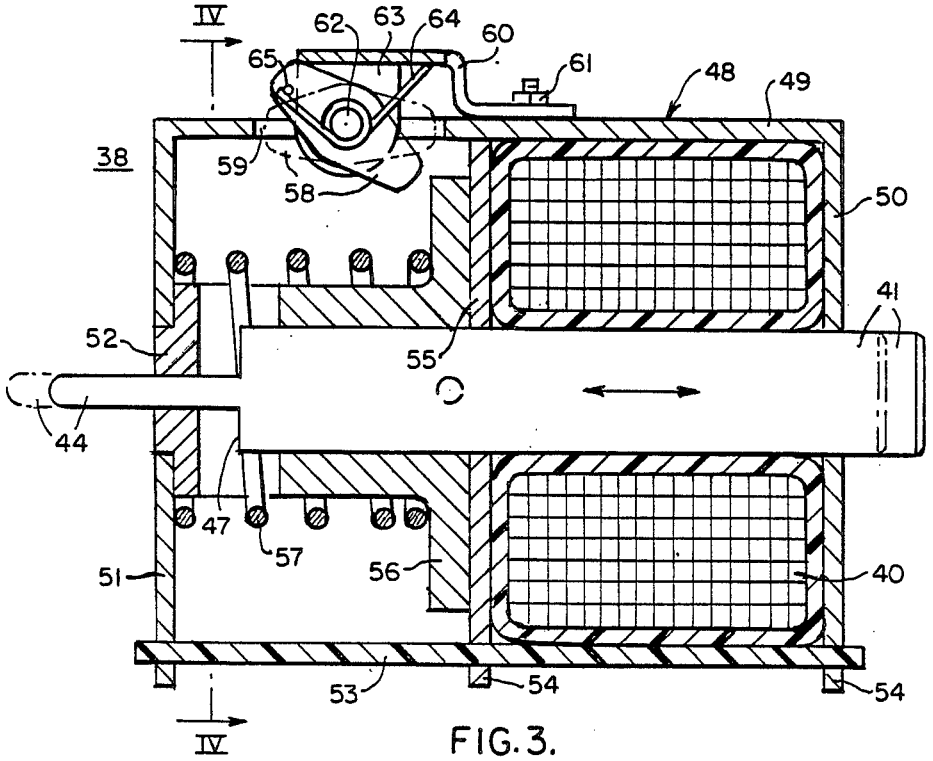
FIG. 3 is a sectional view of the trip-actuating assembly along line III—III of FIG. 2, the solenoid core member and its plunger appendage as well as the rotatable locking component being shown in full lines for illustrative purposes.
Figure 4:
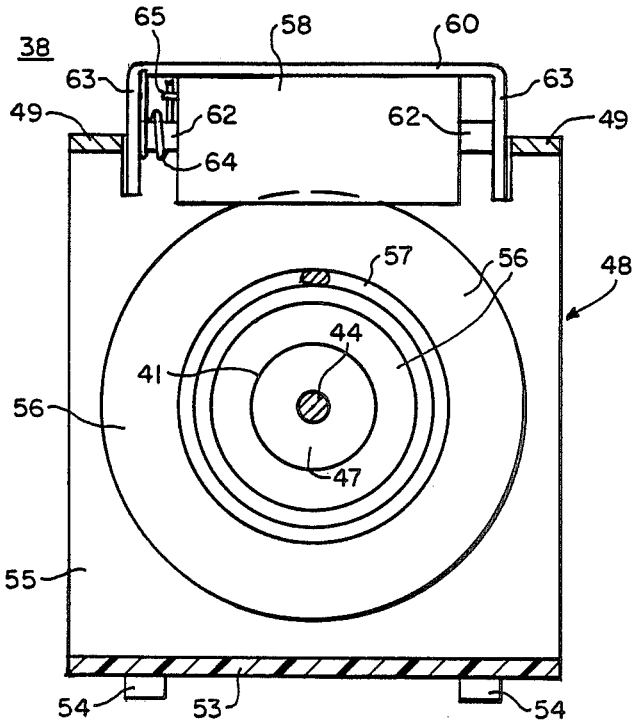
FIG. 4 is another sectional view of the trip-actuating assembly along line IV—IV of FIG. 3.

As shown in FIG. 2 and more particularly in FIG. 3, the trip-actuating assembly 38 comprises a generally rectangular structure of compact size that is formed by housing the solenoid coil winding 40 and its movable core member 41 in a generally U-shaped yoke 48 of magnetic sheet metal (such as steel) that has a top wall 49 and two upstanding end walls 50, 51 and serves as a support chassis. The core member 41 is of cylindrical shape and is reciprocally movable within the bore cavity of the solenoid coil winding 40 and extends through a suitable aperture in the end wall 50. The other end wall 51 is also provided with an opening that receives a circular plug 52 of magnetic or non-magnetic material that has a central bore which slidingly accommodates the rod-like actuator plunger 44 which is integral with and constitutes an axially extending appendage of the solenoid core member 41. The solenoid coil 40 is held in place within the yoke-chassis 48 by a bottom wall 53 of non-magnetic material (such as a suitable plastic) that is press-fitted over lugs 54 that extend from the end walls 50, 51 and a central partition 55 of non-magnetic material that prevents the solenoid coil 40 from shifting laterally within the yoke-chassis 48. A collar 56 of suitable non-magnetic material (such as aluminum) is attached to the solenoid core member 41 and is pressed against the partition 55 by a compression spring 57 that is disposed between end wall 51 and the collar 56. Compression spring 57 accordingly serves as a return spring that automatically resets the solenoid core member 41 and plunger 44 in their dormant NO-TRIP positions shown in full lines in FIGS. 2 and 3.

As will also be noted in FIG. 3, the end face 47 of the solenoid core member 41 is spaced a predetermined distance from the inner face of the plug 52 so that the core member 41, its attached collar 56 and the protruding plunger 44 are reciprocally movable as a unit relative to the solenoid coil 40 and yoke-chassis 48, as indicated by the double-ended arrow in FIG. 3 and the broken-line depiction of the ends of the plunger 44 and core member 41 in FIGS. 2 and 3. The distance traveled by the plunger 44 as it moves in reciprocating fashion along with the solenoid core member 41 and collar 56 is sufficient to swing the pivoted trip bar 35 of the circuit breaker 10 a distance such that it releases the latch 34 of the breaker 10 and initiates the trip sequence. The solenoid core member 41 and its plunger actuator 44 are accordingly reciprocally movable between a TRIP position (depicted by the broken line portions of FIGS. 2 and 3) and a dormant NO-TRIP position (shown by the full line portions of these Figures).

An important feature of the invention is the manner in which the solenoid core member 41 and its plunger actuator 44 are mechanically locked in their dormant NO-TRIP position and are automatically released from such position when the solenoid coil 40 is energized in response to a sensed current overload condition in the electrical circuit being protected. This is achieved by a rotatable member of magnetic material (steel for example) such as a flapper-like keeper 58 of elongated cross-section that is held in an opening 59 in the top wall 49 of the yoke-chassis 48 by a suitably shaped support structure 60 of non-magnetic material that is fastened to the top wall 49 by fasteners 61. The keeper 58 is rotatably coupled (as shown in FIG. 4) to the support structure 60 by axle shafts 62 that extend from the ends of the keeper 58 and are disposed in apertures provided in flanges 63 that extend downwardly from the top wall of the support structure 60 into the opening 59 in the yoke-chassis 48. The keeper 58 is thus freely rotatable within the opening 59 and is of sufficient width that a side-edge portion extends toward and serves as a stop for the peripheral edge portion of the solenoid collar 56 when the solenoid coil 40 is deenergized and the keeper 58 is tilted downwardly toward the collar 56 with the opposite side-edge portion of the keeper in contact with the adjacent edge of the support structure 60. This tilted NO-TRIP position of the keeper 58 and the resulting mechanical interlock which it provides for the solenoid collar 56 and the attached core member 41 and plunger 44 is shown in full lines in FIG. 3.

A torsion spring 64 disposed around one of the axle shafts 62 of the keeper 58 and held in place by a pin 65 on the keeper 58 and the adjacent edge of the support structure 60 applies a bias to the keeper 58 which tilts it downwardly into its solenoid-locking position (shown in FIGS. 2–4) when the solenoid coil 40 is deenergized and the core member 41, plunger 44 and collar 56 are disposed in their NO-TRIP positions, illustrated by the full-line portions of FIGS. 2 and 3.

Automatic release of the solenoid core member 41 and plunger 44 from their locked NO-TRIP positions is achieved in accordance with the invention by the magnetic flux which is produced in the yoke opening 59 by the energized solenoid coil 40 and the yoke-chassis 48 which serves as a magnetic circuit means. Since the magnetic flux spans the yoke opening 59 along a straight path it causes the magnetic keeper 58 to rotate to its broken-line position (shown in FIG. 3) against the action of the spring 64 until it is automatically aligned with the plane defined by the top wall 49 of the yoke-chassis 48. Such magnetically induced rotation of the keeper 48 releases the core member 41, plunger 44 and collar 56 from their locked NO-TRIP positions and permits the energized solenoid coil 40 to rapidly propel the core member 41 and plunger 44 into their TRIP positions depicted by the broken-line portions of FIGS. 2 and 3. Once the solenoid coil 40 is energized the rotation of the keeper 58 and the propulsion of the unlocked core member 41 and plunger 44 to their TRIP positions occur simultaneously so that the trip bar 35 of the circuit breaker 15 is actuated and initiates the trip sequence within a few milliseconds after the current overload condition in the circuit is sensed and the solenoid coil 40 is energized.

After the circuit breaker 10 has been tripped and the solenoid coil 40 is deenergized, the compression spring the solenoid coil 40 is deenergized, the compression spring 57 automatically restores the core member 41, plunger 44 and collar 56 to their dormant NO-TRIP positions and the biasing spring 64 automatically tilts the keeper 58 downwardly through the yoke opening 59 into interlocking relationship with the peripheral edge of the solenoid collar 56. The trip-actuator assembly 38 is accordingly restored to its original NO-TRIP condition and is automatically reset for another trip-actuating operation.

In accordance with a preferred embodiment of the invention, the U-shaped yoke-chassis 48 is fabricated from sheet steel to provide an efficient magnetic circuit means and the central partition 55 and keeper-support structure 60, as well as its flanges 63, are fabricated from aluminum or other non-magnetic metal. The bottom wall 53 of the assembly 38 can be fabricated from a suitable rigid plastic.

In the FIG. 1 embodiment the circuit breaker 10 is tripped on power which is derived from the current transformer 45 that is coupled to the main conductor 24 of the breaker which is connected to the electrical circuit being protected. The output of the current transformer 45 is fed into a suitable electronic sensing circuit which produces a trip signal that is fed into a trigger transistor that is in series with and supplies sufficient energizing current to the solenoid coil 40 derived from the transformer action and the fault current. The electronic sensing circuit and the trigger transistor comprise parts of the solid state control module 42 that is mounted within the circuit breaker housing 12 as illustrated in FIG. 1.

Figure 5:
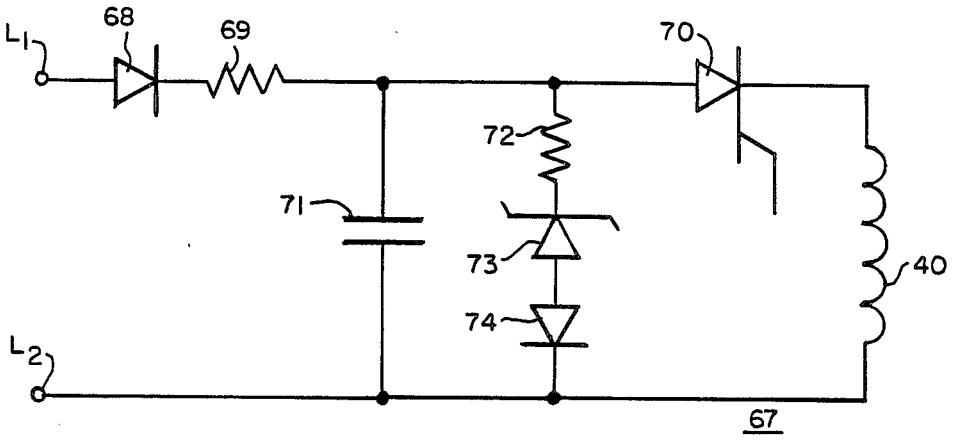
FIG. 5 is a schematic of the control and power circuit used in the circuit breaker shown in FIG. 1 for energizing the trip solenoid and plunger in response to circuit overload conditions.

An alternative solid state circuit 67 for energizing the solenoid coil 40 in response to a detected current overload condition in the electrical circuit is shown in FIG. 5. The circuit 67 would be energized by tapping it into the internal main conductors 22, 24 of the circuit breaker 10 or by connecting the circuit terminals $L_1$ and $L_2$ to a separate power supply provided in the well-known manner for operation of the circuit breaker 10. As illustrated, the solenoid winding 40 is connected in series with a rectifier 68, a limiting resistor 69 and a trigger transistor 70 that is fed with a trip signal generated by a suitable sensor (not shown). An energy storage capacitor 71 is connected in parallel with the solenoid winding 40 and also in parallel with another resistor 72, a Zener diode 73 and a rectifier 74 which limits the voltage on the capacitor 71. All of the aforesaid components, with the exception of the solenoid winding 40, constitute parts of the solid state module 42 that is mounted within the circuit breaker housing 12 as illustrated in FIG. 1.

Figure 6:
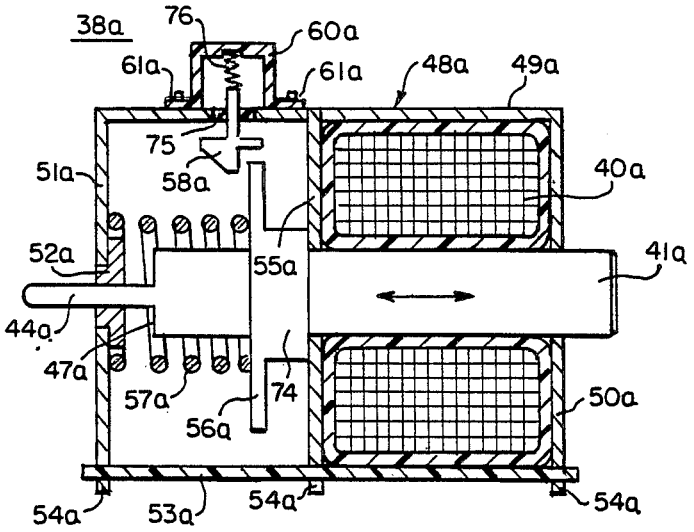
FIG. 6 is a cross-sectional view of an alternative trip-actuating assembly that utilizes a reciprocally-movable locking member.
Figure 6A:
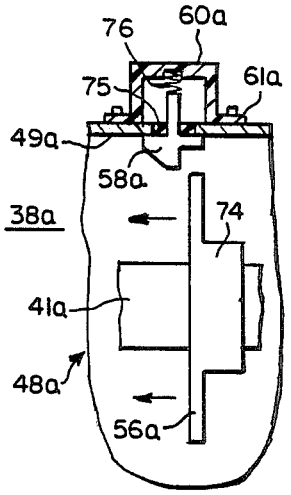
FIG. 6A is a fragmentary view of the alternative assembly shown in FIG. 6 with the locking member in retracted position.

ALTERNATIVE TRIP-ACTUATOR EMBODIMENT (FIGS. 6 and 6A)

An alternative trip-actuating assembly **38*a* which employs a different mode of mechanically locking and releasing the solenoid core member and actuator-plunger is illustrated in FIGS. 6 and 6A** and will now be described.

As shown in FIG. 6, the trip-actuating assembly **38*a* is basically of the same construction as the FIGS. 2–4 embodiment in that it comprises a yoke-chassis 48*a* of magnetic material that has a top wall 49*a*, end walls 50*a* and 51*a* and an insulative bottom wall 53*a* which form a housing that encloses and supports the solenoid winding 40*a* and its reciprocally movable core member 41*a* and depending plunger 44*a*. The annular collar 56*a* extends laterally from the core member 41*a* and has shank portion 74 of reduced diameter that is seated against the central partition 55*a* by the action of the return spring 57*a* that is disposed between the collar 56*a* and end wall 51*a* of the yoke-chassis 48*a*. The shank portion 74 thus acts as a stop for the core member 41*a* and plunger 44*a* when the trip-actuating assembly 38*a* is in its dormant NO-TRIP mode shown in FIG. 6. The plunger 44*a* extends through a bushing 52*a* of suitable material (either magnetic or non-magnetic) that is fitted into a suitable opening in the end wall 51*a* and provides a seat for the associated end of the return spring 57*a* and end face 47*a* of the core member 41*a***.

In contrast to the previous embodiment, the solenoid core member **41*a* and its plunger 44*a* are locked in their NO-TRIP positions by a spindle-like component such as a keeper 58*a* of magnetic material that is reciprocally movable in a lateral direction toward and away from the solenoid collar 56*a* and is held in such relationship by an apertured plug 75 of suitable non-magnetic material that is secured in an opening provided in the top wall 49*a* of the yoke-chassis 48*a*. The keeper 58*a* has an enlarged head portion that serves as a pawl with a notched and tapered profile. A small compression spring 76 provided between the end of the keeper 58*a* and top wall of the non-magnetic support structure 60*a* pushes the keeper 58*a* toward the solenoid core member 41*a* when the solenoid coil 40*a* is deenergized so that the notched tip of the keeper 58*a* extends beyond and thus serves as a mechanical interlock for the peripheral edge of the solenoid collar 56*a*, as shown in FIG. 6. This mechanical interlock ensures that the trip-actuating assembly 38*a*** will remain in its dormant NO-TRIP mode despite severe mechanical shock and vibration experienced by the circuit breaker in which it is used.

When a current overload condition is detected by the control module within the circuit breaker and the solenoid coil **40*a* is energized, the magnetic circuit provided by the yoke-chassis 48***a* produces a magnetic flux in the yoke opening fitted with the non-magnetic plug 75 with the result that the pawl-shaped keeper 58*a* is attracted toward the top wall 49*a* of the yoke-chassis 48*a* against the action of the compression spring 76 until the transverse bar portion of the keeper 58*a* contacts and is seated against the plug 75, as shown in 6A. This permits the solenoid collar 56*a* to clear the notched tip of the retracted keeper 58*a*, thus releasing the solenoid core member 41*a*, collar 56*a* and plunger 44*a* from their locked NO-TRIP positions. The energized solenoid coil 40*a* simultaneously causes the released core member 41*a* to be rapidly propelled toward the end wall 51*a* of the yoke-chassis 48*a* until the end 47*a* of the core member 41*a* strikes and is seated against the bushing 52*a*. The protruding tip of the plunger 44*a* is accordingly also rapidly advanced and swings the pivoted trip bar of the circuit breaker the distance required to release the trip latch and initiate the breaker-tripping sequence.

After the circuit breaker has been tripped and the circuit interrupted, the solenoid coil 40*a* is deenergized—thus permitting the compression spring 57*a* to return the core member 41*a* and plunger 44*a* to their NO-TRIP positions. The resulting collapse of the magnetic field also releases the keeper 58*a* and permits it to be automatically returned to its mechanically interlocked relationship with the peripheral edge of the solenoid collar 56*a* by the action of spring 76. The actuating assembly 38*a* is thus automatically reset for the next trip operation.

ALTERNATIVE LOCKING MEANS FOR ACTUATOR (FIGS. 7–12)

An alternative rotative "key" arrangement for mechanically locking a trip actuator in dormant NO-TRIP position and then automatically releasing it with electromagnetic forces generated in response to a current overload condition in accordance with the invention is illustrated in FIGS. 7–12.

Figure 7:
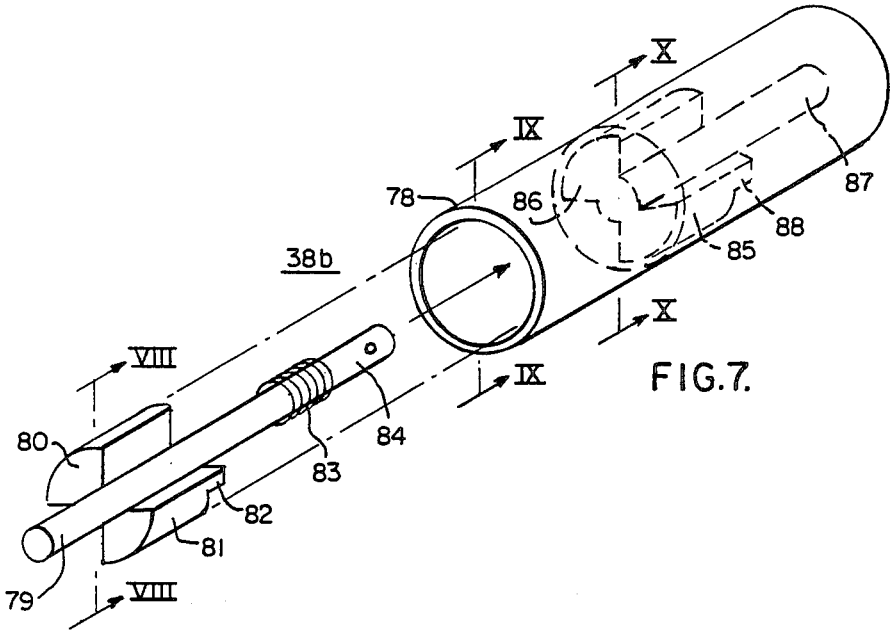
FIG. 7 is a pictorial exploded view of another alternative trip-actuating assembly which employs a rotary key-fit arrangement for mechanically locking and releasing the plunger component of the solenoid.
Figure 8:
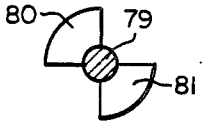
FIGS. 8, 9 and 10 are cross-sectional views of the alternative trip-actuating assembly shown in FIG. 7, taken along the correspondingly-numbered lines of this Figure.
Figure 9:
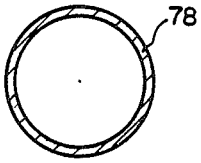

As shown in FIG. 7, the trip-actuator assembly 38*b* in accordance with this embodiment comprises a stationary cylindrical housing 78 of non-magnetic material having a specially shaped passageway for receiving the movable plunger component 79 of the assembly. As will be noted from the cross-sectional view of the housing 78 shown in FIG. 9, the end portion of the housing 78 that receives the plunger component 79 defines a cylindrical passageway which is dimensioned to slidingly receive a pair of arcuate lobe segments 80, 81 that laterally extend in opposite directions from the plunger 79 (FIG. 8) and are fabricated from magnetic material. Lobe segment 81 has an axially extending lug 82 and the plunger 79 is of cylindrical rod-like shape and provided with a torsion spring 83. The length of the plunger 79 relative to the tubular housing 78 is such that the tip 84 of the plunger 79 extends beyond the housing 78 when the actuator 38*b* is in its released TRIP mode (shown in FIG. 11).

Figure 10:
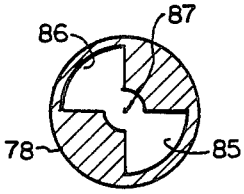
Figure 11:
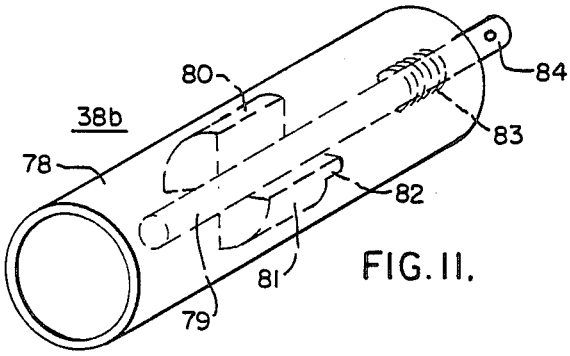
FIG. 11 is a perspective view of the trip-actuating assembly of FIG. 7 in its unlocked released condition.

As illustrated in the cross-sectional view through the medial portion of the housing 78 illustrated in FIG. 10, this part of the housing is configured to provide two laterally extending passageways 85, 86 and a central cylindrical passageway 87 that are shaped and dimensioned to slidingly accommodate in key-lock fashion the lobed segments 80, 81 and end portion 84 of the plunger 79. The plunger 79 is accordingly freely rotatable when its lobed portion is located within the cylindrical end portion of the housing 78 and it is only movable along the housing 78 in an axial direction when the plunger 79 is rotated through an angle such that the lobe segments 80, 81 mate with and enter the passageways 85, 86 of the housing. Housing passageway 85 is contoured to provide a recess 88 shaped and oriented to receive the lug portion 82 of the plunger lobe 81 and thus serve as a stop which controls the axial movement of the plunger 79.

The torsion spring 83 is attached to the end portion 84 of the plunger 79 and to the wall of the stationary cylindrical housing 78 (after the end 84 of the plunger 79 has been inserted through the cylindrical passageway 87 of the housing). The torsion spring 83 acts in a direction which rotates the plunger 79 into its mechanically locked NO-TRIP position—that is, with the plunger lobes 80, 81 rotationally displaced from the mating passageways 85, 86 of the housing 78. Suitable stops (not shown) on the inner wall surface of the housing 78 prevent the plunger 79 from being rotated by the torsion spring 83 beyond a predetermined angle selected to unlock the plunger. Rotation of the plunger 79 through the aforesaid angle required to align the lobes 80, 81 with the housing passageways 85, 86 and thus effect the release and axial movement of the plunger 79 required to trip the circuit breaker is achieved by positioning a small electromagnet (not shown) adjacent the portion of the stationary housing 78 that contains the lobes 80, 81. This electromagnet is powered by solid-state circuit module provided within the circuit breaker (or by the incoming line current) and is so oriented that its magnetic field rotates the lobed portion of the plunger 79 through the aforesaid angle.

Figure 12:
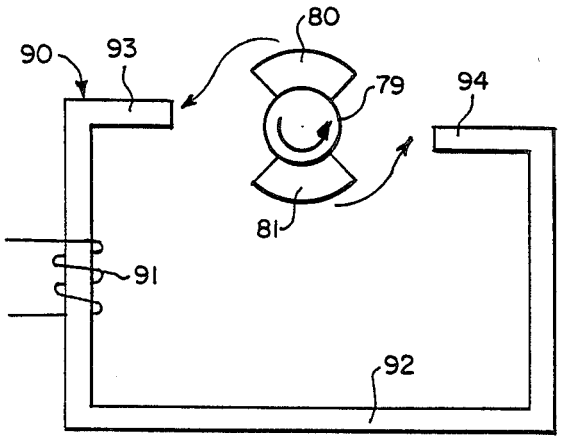
FIG. 12 is a schematic representation of the magnetic circuit employed in the FIGS. 7–11 embodiment and the manner in which the lobed portion of the actuator core is magnetically rotated into its unlocked released position.

A schematic representation of the manner in which an electromagnet 90 is employed to apply the necessary torque to the rotatable plunger 79 required to align the magnetic lobes 80, 81 with the matching passageways 85, 86 in the stationary housing 78 and release the trip-actuator 38*b* is shown in FIG. 12. The electromagnet 90 comprises the usual coil 91 and a steel yoke 92 that provides a flux path and has pole pieces 93, 94 that are located adjacent the lobed portion of the plunger 79 which is also fabricated from steel. When the electromagnet 90 is energized, the magnetic flux in the air gaps separating the pole pieces 93, 94 from the lobes 80, 81 of the plunger 79 produces a torque which causes the plunger 79 to rotate in the manner indicated by the arrows until the lobes 80, 81 are aligned with the pole pieces 93, 94. The magnetically-induced rotational force applied to the lobed portion of the plunger 79 by the energized electromagnet 90 is sufficient to overcome the counteracting torsional force of the spring 83 (FIGS. 7 and 11) and thus rotate the plunger 79 into its keyed unlocked position within housing 78.

The amount of torque developed by the interaction of the lobed portion of the steel plunger 79 and the electromagnet 90 is proportional to the current flowing through the coil 91 which, in turn, is directly proportional to the level of current flowing through the breaker. This arrangement would accordingly be identical to that employed in a conventional magnetic trip breaker. If desired, a suitable bimetallic heater element can also be provided within the circuit breaker to apply a rotative force to the plunger 79 sufficient to move it into its keyed unlocked position. If such a bimetallic heater element were combined with the electromagnet 90 the resulting arrangement would provide a breaker that would trip on either a thermal or magnetic signal.

ROTATIVE TRIP-ACTUATING EMBODIMENT (FIGS. 13–14)

Figure 14:
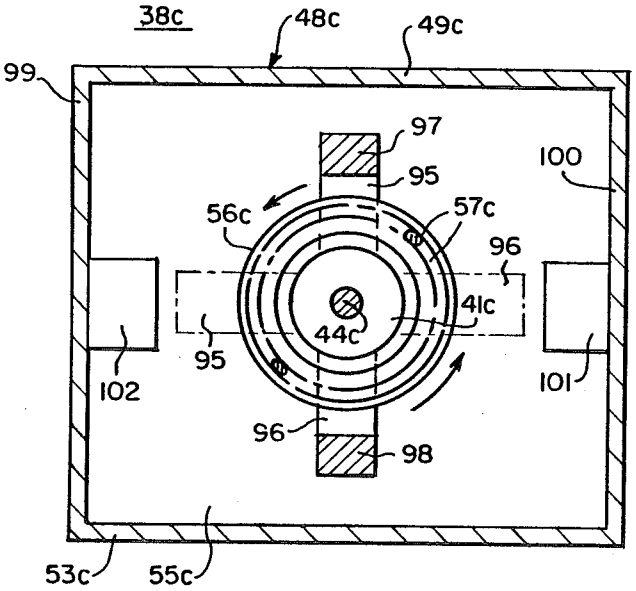
FIG. 14 is a cross-sectional view of this alternative embodiment, along line XIV—XIV of FIG. 13.
Figure 13:
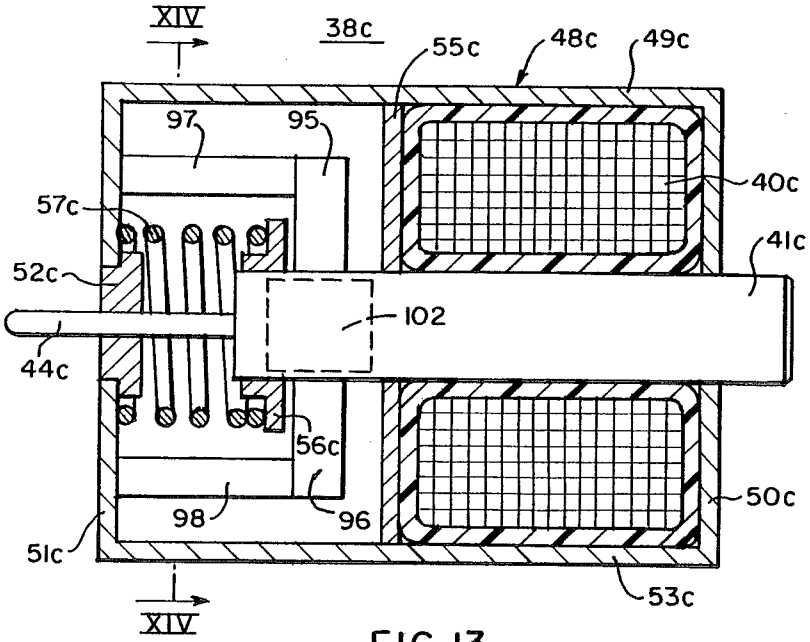
FIG. 13 is a sectional view of still another alternative embodiment of the trip-actuating assembly according to the present invention which utilizes the rotative key-fit locking and release arrangement employed in the FIGS. 7–11 embodiment.

A solenoid powered trip-actuating assembly 38c which embodies a variation of the rotative locking and key-releasing concepts of the FIGS. 7–12 embodiment is shown in FIGS. 13 and 14.

As will be noted in FIG. 13, the trip-actuating assembly 38c comprises a solenoid winding 40c, a reciprocally-movable core member 41c, plunger appendage 44c, central partition 55c and a return compression spring 57c that are disposed within a magnetic yoke-chassis 48c in accordance with the basic structural design employed in the previously described FIGS. 2–6 embodiments. When the actuating assembly 38c is in locked NO-TRIP condition shown in FIGS. 13 and 14, a pair of laterally-extending magnetic lobes 95, 96 on the solenoid core member 41c rest upon a pair of longitudinally extending stops 97, 98 of non-magnetic material that are secured to the end wall 51c of the yoke-chassis 48c. As shown in FIG. 14, in accordance with this embodiment the yoke-chassis 48c includes a pair of side walls 99, 100 of magnetic material that are provided with a pair of pole pieces 101, 102 which are displaced 90° from the stops 97, 98.

When the solenoid coil 40c is energized by the solid-state circuit module within the circuit breaker in response to a current-overload condition the magnetic flux produced in the gap separating the pole pieces 101, 102 by the yoke-chassis 48c generates a torque which causes the lobed portion of the core member 41c to rotate (in the manner depicted by the arrows in FIG. 14) until the lobes 95, 96 are aligned with the pole pieces 101, 102 (as shown by the broken-line portions of FIG. 14). When the lobes 95, 96 are rotated through an angle sufficient to slide off and clear the stops 97, 98, the core member 41c will automatically be unlocked and then be simultaneously propelled by the electromotive force of the energized coil 40c in an axial direction through a distance such that the protruding tip of the plunger 44c hits and actuates the trip bar of the circuit breaker.

When the solenoid coil 40c is deenergized after the tripping sequence, the return spring 57c moves the core member 41c and plunger 44c to their original NO-TRIP position. The return spring 57c is attached to the solenoid collar 56c and to the end wall 51c of the yoke-chassis 48c and is coiled in such a manner that it also applies the required rotational force to the core member 41c and plunger 44c to return the solenoid lobes 95, 96 to their locked positions on top of the respective stops 97, 98.

In contrast to the FIGS. 2–6 embodiments, both the top wall 49c and bottom wall 53c of the yoke-chassis 48c are made of steel or ther suitable magnetic material to provide an efficient magnetic circuit from the solenoid coil 40c to the pole pieces 101, 102.

To minimize friction, the end faces of the lobes 95, 96 and the surfaces of the stop abutments 97, 98 which are in sliding contact are substantially flat and smooth.

We claim:

1. In combination with a circuit breaker having a housing of insulating material that contains a pair of contacts one of which is movable into make-circuit and break-circuit relationship with the other contact by a spring-powered operating mechanism that includes a toggle assembly and a latch component, a trip member pivotally mounted within said housing and adapted to engage and releasably capture said latch component when the operating mechanism is spring-loaded and thereby maintain the operating mechanism and contacts in make-circuit relationship, said trip member being actuable to release said latch component and permit the spring-loaded operating mechanism to rapidly separate the contacts and swing the movable contact to break-circuit position, means for actuating said trip member and tripping the circuit breaker in response to a current-overload condition, comprising;

an elongated actuator reciprocally movable along a path and through a distance such that the end of said actuator strikes said trip member and releases said latch component when the actuator is moved from a dormant NO-TRIP position to a TRIP position, means responsive to a current-overload condition for rapidly moving the actuator from NO-TRIP to TRIP position, means mechanically locking the plunger in dormant NO-TRIP position, means for releasing said locking means in response to a current-overload condition and in synchronism with the actuation of the actuator-moving means so that the actuator is automatically motivated and initiates the tripping sequence within a predetermined period of time after the current-overload condition occurs, the actuator-moving means comprising a solenoid that has a wire coil and a reciprocally-movable magnetic core member and is mounted within the circuit breaker housing adjacent the trip member, the actuator comprises a longitudinally extending appendage of said solenoid core member, the actuator-locking means comprises a keeper of magnetic material that is movable into and out of abutting engagement with a laterally-protruding portion of the solenoid core member, said keeper is mounted in such relationship with the solenoid core member on a yoke of magnetic material that is secured to and provides a chassis for the solenoid core member and wire coil, and said yoke-chassis being so structured that magnetic flux generated by the energized solenoid is conducted by said yoke to the magnetic keeper and produces a magnetic field that retracts the keeper from abutting engagement with the solenoid core member when the solenoid is energized and thus releases the solenoid core member and actuator from locked NO-TRIP position.

2. The combination of claim 1 wherein;

said yoke-chassis is generally U-shaped, fabricated from sheet metal, and has a wall portion with an opening therein, and said magnetically-actuable keeper is disposed in the wall opening of said yoke-chassis.

3. The combination of claim 2 wherein;

the solenoid core member has a laterally-protruding portion that extends toward the wall opening of the yoke-chassis and the magnetically-actuable keeper is disposed in said opening, the magnetically-actuable keeper is movable toward and away from the laterally-protruding portion of the solenoid core member, and the magnetically-actuable keeper is also so oriented and is of such configuration that the peripheral edge of the laterally-protruding portion of the solenoid core member is engaged by the keeper when the keeper is in locking position and clears the keeper when the keeper is in retracted release position.

4. The combination of claim 3 wherein;

the magnetically-actuable keeper comprises a rotatable flapper-like member of elongated cross-section, and said flapper-like keeper member is pivotally mounted within a holder that is fabricated from non-magnetic material and secured to the yoke-chassis proximate the wall opening therein.

5. The combination of claim 3 wherein;

the magnetically-actuable keeper comprises a spindle-like component that extends through the wall opening in the yoke-chassis and is reciprocally movable relative to the associated wall of the yoke-chassis, and said spindle-like component is retained in such reciprocally-movable relation by a holder of non-magnetic material that is secured to the yoke-chassis, is substantially aligned with and extends outwardly from the wall opening in the yoke-chassis, and includes a plug that is disposed in the wall opening and sliding accommodates said spindle-like component, and said spindle-like component having a transverse bar portion that is seated against the plug component and serves as a stop for said spindle-like component when said component is in retracted release position.

6. In combination with a circuit breaker having a housing of insulating material that contains a pair of contacts one of which is movable into make-circuit and break-circuit relationship with the other contact by a spring-powered operating mechanism that includes a toggle assembly and a latch component, a trip member pivotally mounted within said housing and adapted to engage and releasably capture said latch component when the operating mechanism is spring-loaded and thereby maintain the operating mechanism and contacts in make-circuit relationship, said trip member being actuable to release said latch component and permit the spring-loaded operating mechanism to rapidly separate the contacts and swing the movable contact to break-circuit position, means for actuating said trip member and tripping the circuit breaker in response to a current-overload condition, comprising;

an elongated actuator reciprocally movable along a path and through a distance such that the end of said actuator strikes said trip member and releases said latch component when the actuator is moved from a dormant NO-TRIP position to a TRIP position, means responsive to a current-overload condition for rapidly moving the actuator from NO-TRIP to TRIP position, means mechanically locking the plunger in dormant NO-TRIP position, means for releasing said locking means in response to a current-overload condition and in synchronism with the actuation of the actuator-moving means so that the actuator is automatically motivated and initiates the tripping sequence within a predetermined period of time after the current-overload condition occurs, the actuator-moving means comprising a solenoid that has a wire coil and a reciprocally-movable magnetic core member and is mounted within the circuit breaker housing adjacent the trip member, the actuator comprises a longitudinally extending appendage of said solenoid core member, the solenoid is supported within the circuit breaker housing by a yoke of magnetic material that extends around the wire coil and core member of the solenoid, the yoke has side walls and a pair of end walls that are joined to one another and form a chassis, each of the end walls of the yoke-chassis having an aperture therein that effects a slip-fit with the plunger and opposite end of the solenoid core member and permit the plunger-core member component of the solenoid to move reciprocally between said TRIP and NO-TRIP positions and also rotate.

the actuator-locking means comprises (a) a laterally-extending lobe of magnetic material on an exposed portion of the solenoid core member, (b) stop means integral with the yoke-chassis for engaging the magnetic lobe of the solenoid core member when the solenoid core member is in NO-TRIP position and then permitting passage of the lobe and reciprocal movement of the solenoid core member when the solenoid core member is rotated through a predetermined angle, and (c) magnetic pole means integral with the yoke-chassis for producing a magnetic field, when the solenoid is energized, which interacts with the magnetic lobe of the solenoid core member in a manner such that the solid core member and plunger are rotated through said predetermined angle and the lobe clears and slips past the stop means with concomitant release and reciprocal movement of the solenoid core member and actuator.

7. The combination of claim 6 wherein;

said yoke-chassis is fabricated from magnetic sheet material, the solenoid core member has two magnetic lobes that are radially spaced from one another and have smooth substantially flat end faces, said stop means comprises a pair of stationary abutments of non-magnetic material that are secured to an end wall of the yoke-chassis and are spaced to be aligned with and engage the substantially flat end faces of the lobes when the solenoid core member is in NO-TRIP position and permit the longitudinal passage and reciprocal movement of the solenoid core member and actuator into TRIP position when the solenoid is energized, the surfaces of said stop abutments that engage the lobes of the solenoid core member are also substantially flat so that the lobes slide over and then pass the stop abutments when the solenoid core member and actuator are rotated through said predetermined angle, and a coiled spring is disposed in captured relationship between the lobed portion of the solenoid core member and the proximate end wall of the yoke-chassis, said spring being secured to the solenoid core member and proximate end wall and being so oriented that compressive and torsional tensions in the spring automatically restore the lobed portion of the solenoid core member to locked position on the stop abutments after the circuit breaker has been tripped and the solenoid is deenergized.

* * * * *